US009398662B2

(12) United States Patent
Guan

(10) Patent No.: US 9,398,662 B2
(45) Date of Patent: Jul. 19, 2016

(54) LED CONTROL SYSTEM

(71) Applicant: Shan Guan, Fremont, CA (US)

(72) Inventor: Shan Guan, Fremont, CA (US)

(73) Assignee: LUCIS TECHNOLOGIES HOLDINGS LIMITED, Grand Cayman (KY)

( * ) Notice: Subject to any disclaimer, the term of this patent is extended or adjusted under 35 U.S.C. 154(b) by 0 days.

(21) Appl. No.: 14/494,406

(22) Filed: Sep. 23, 2014

(65) Prior Publication Data

US 2016/0088701 A1 Mar. 24, 2016

(51) Int. Cl.

| | |
|---|---|
| ***H05B 37/04*** | (2006.01) |
| ***H05B 33/08*** | (2006.01) |
| *H05B 39/04* | (2006.01) |
| *H05B 39/08* | (2006.01) |
| *H05B 41/392* | (2006.01) |

(52) U.S. Cl.

CPC ..... *H05B 33/0851* (2013.01); *H05B 33/0815* (2013.01); *H05B 33/0845* (2013.01); *H05B 33/0848* (2013.01); *H05B 39/041* (2013.01); *H05B 39/081* (2013.01); *H05B 41/3921* (2013.01)

(58) Field of Classification Search

CPC ..... H05B 33/0854; H05B 37/0281; H05B 33/0845; H05B 33/0848; H05B 39/041; H05B 39/081; H05B 41/3921; Y01T 307/891

USPC ..... 315/291, 159, 307, 224, 310, 362, 287, 315/209 SC, 127

See application file for complete search history.

(56) References Cited

U.S. PATENT DOCUMENTS

| | | | | | |
|---|---|---|---|---|---|
| 4,414,493 | A * | 11/1983 | Henrich | H05B 41/3922 | 315/149 |
| 4,695,739 | A * | 9/1987 | Pierce | G04G 15/006 | 307/132 M |
| 4,760,483 | A * | 7/1988 | Kugelman | H01H 9/542 | 307/135 |
| 4,878,010 | A * | 10/1989 | Weber | H02M 5/257 | 323/300 |
| 5,789,869 | A * | 8/1998 | Lo | H05B 37/0218 | 250/214 AL |
| 7,436,132 | B1 * | 10/2008 | Null | H05B 37/0218 | 315/158 |
| 2004/0124786 | A1 * | 7/2004 | Morrissey Jr. | H05B 37/0218 | 315/291 |
| 2005/0281030 | A1 * | 12/2005 | Leong | F21K 9/00 | 362/234 |
| 2008/0079568 | A1 * | 4/2008 | Primous | H05B 37/0218 | 340/541 |
| 2011/0095697 | A1 * | 4/2011 | Ludorf | H05B 33/0854 | 315/287 |
| 2012/0112638 | A1 * | 5/2012 | Melanson | H05B 33/0815 | 315/117 |
| 2012/0112639 | A1 * | 5/2012 | Melanson | H05B 33/0815 | 315/126 |
| 2013/0170263 | A1 * | 7/2013 | Newman, Jr. | H02M 7/06 | 363/126 |
| 2015/0156852 | A1 * | 6/2015 | Primous | H05B 37/0218 | 315/153 |

* cited by examiner

*Primary Examiner* — Douglas W Owens
*Assistant Examiner* — Borna Alaeddini

(57) ABSTRACT

A LED control circuit is disclose which comprises a silicon-controlled rectifier (SCR) configured to control a first current supplied to a LED light bulb, and a dynamic current maintenance module serially coupled to the SCR and configured to draw a second current from the SCR, the second current being inversely proportional to the first current.

6 Claims, 4 Drawing Sheets

LED CONTROL SYSTEM

BACKGROUND

The present invention relates generally to switching of electrical power supply, and, more particularly, to LED control system.

Light emitting diode (LED) as a light source has the advantage of lower power consumption and excellent shock resistance. Conventionally, LED light is merely turned on and off, without dimming function and cannot be adjusted to match the needs at different seasons and at different ambient light situations.

Silicon controlled rectifier (SCR) has been used to efficiently adjust light output of resistive incandescent light bulbs. However, the SCR cannot be adequately used with LED light bulbs, because LED light bulbs generally include a switching power supply, which may have hundreds or even thousands of pulses, i.e., current cut-off periods, per cycle of an alternating current (AC). Even if the current is not completely cut off at valleys of the pulses, the reduced current may not be able to sustain SCR's conduction and cause the SCR to unexpectedly shut off, especially when the LED light bulb is of lower power rating or being adjusted to lower power output. The SCR can only be turned back on by next trigger. As a result, the LED light may exhibit abnormal light output or blink.

As such, what is desired is a control system that can efficiently adjust LED light output.

Figure 1:
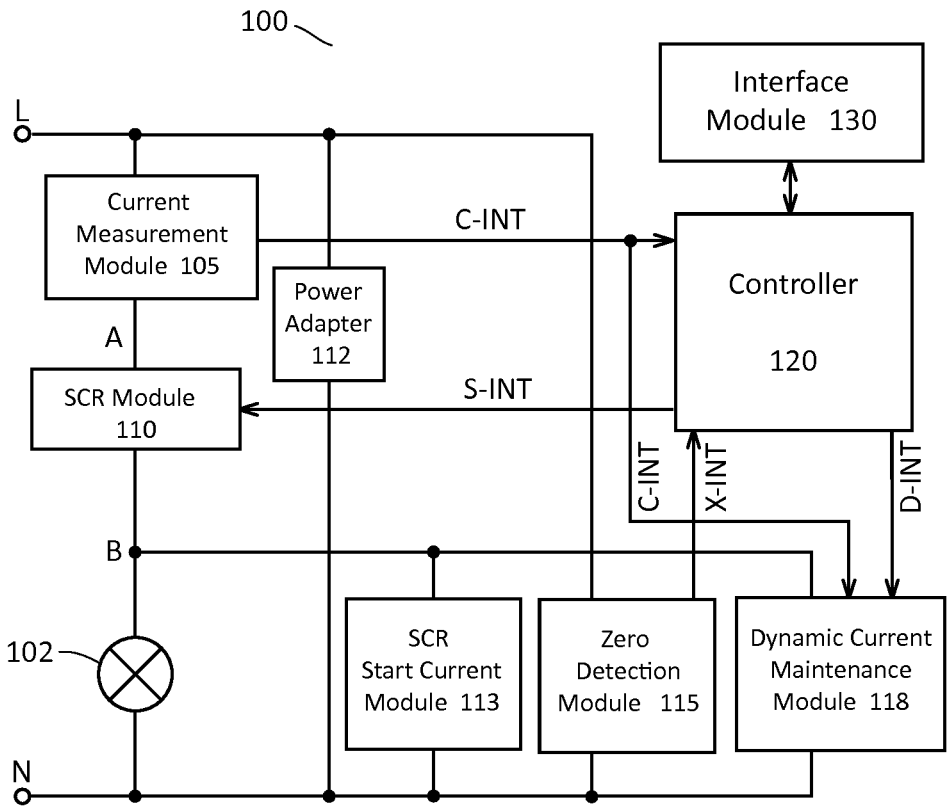
FIG. 1 is a block diagram illustrating a LED control system according to an embodiment of the present invention.

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein.

DESCRIPTION

The present invention relates to a LED control system utilizing silicon controlled rectifier (SCR) to efficiently adjust output of LED light bulb. Preferred embodiments of the present invention will be described hereinafter with reference to the attached drawings.

FIG. 1 is a block diagram illustrating a LED control system 100 according to an embodiment of the present invention. The LED control system 100 includes a current measurement module 105 and a SCR module 110 serially coupled to a LED light bulb 102 between a live wire L and a neutral wire N of an alternating current (AC) power supply. The current measurement module 105 measures current flowing through the LED light bulb 102 and provides a control signal C-INT generated from the measured current to a controller 120. The SCR module 110 having one or more SCR units adjusts the current flowing through the LED light bulb 102 and hence light output under the control of the controller 120. A control signal S-INT is coupled from the controller 120 to the SCR module 110. The controller 120 also communicates with an interface module 130, which interacts with environment as well as operators Referring again to FIG. 1, the LED control system 100 further includes a SCR start current module 113, a zero detection module 115 and a dynamic current maintenance module 118 all are parallelly coupled to the LED light bulb 102 between the neutral wire N and a live wire B. The SCR start current module 113 provides initial conduction current to the SCR module 110 upon the SCR units being triggered. The zero detection module 115 detects the AC current and provides a signal X-INT to the controller 120 indicating a moment when the AC current crosses zero. The dynamic current maintenance module 118 provides a current to the SCR units to maintain their conduction. The dynamic current maintenance module 118 is controlled by the controller 120 through a control signal D-INT.

Referring again to FIG. 1, the LED control system 100 further includes a power adapter 112 connected directly to the live wire L and the neutral wire N, and drawing AC power directly from the live wire L. The power adapter 112 converts AC power to DC power which is supplied to the controller 120 and the interface module 130. By connecting directly to the live wire L, the power adapter 112 is not affected by the SCR module 110, therefore, the power supply to the controller 120 and the interface module 130 will not be interrupted.

Figure 2:
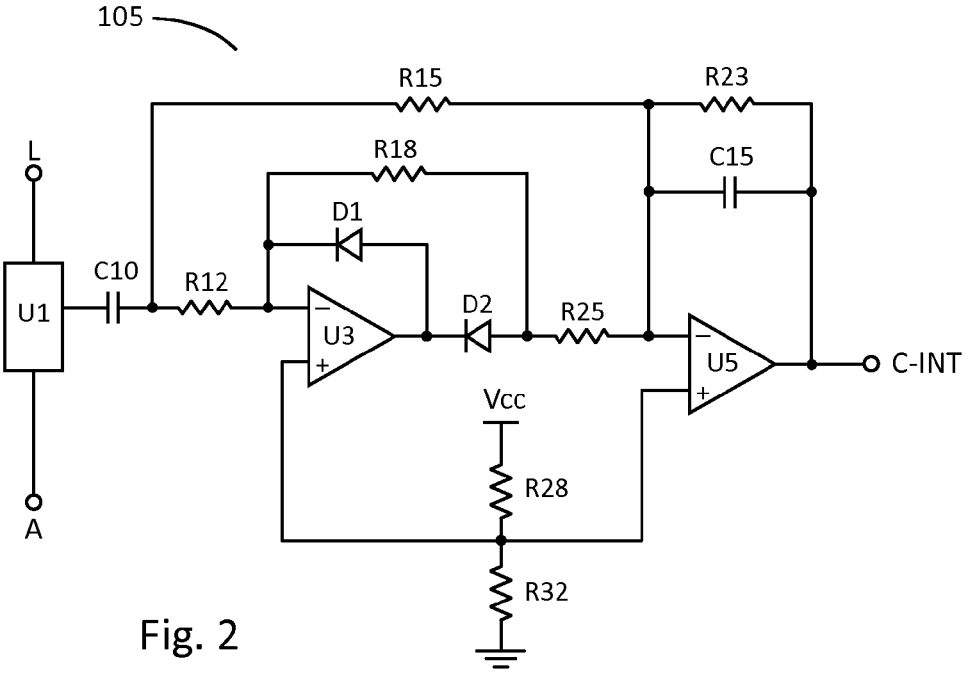
FIG. 2 is a schematic diagram illustrating an embodiment of the current measurement module.

FIG. 2 is a schematic diagram illustrating an embodiment of the current measurement module 105. The current measurement module 105 employs a Hall effect transducer U1 for converting an AC current flowing through the live wire L and a node A to a voltage which is coupled, through a capacitor C10 and a resistor R12, to a rectifier comprising diodes D1 and D2 and an operational amplifier U3 and associated resistors R15, R18 and R25. As shown in FIG. 1, the current flowing through the live wire and the node A is the same current that flows through the LED light bulb 102. An output of the operational amplifier U3 is amplified by another operational amplifier U5 and associated capacitor C15 and resistor R23. Resistors R28 and R32 serially connected between a high direct current voltage (Vcc) and a ground provide a reference voltage to the operational amplifiers U3 and U5. An output (C-INT) of the operational amplifier U5 is a full wave rectified signal with amplitude proportional to the current flowing through the LED light bulb 102.

Figure 3:
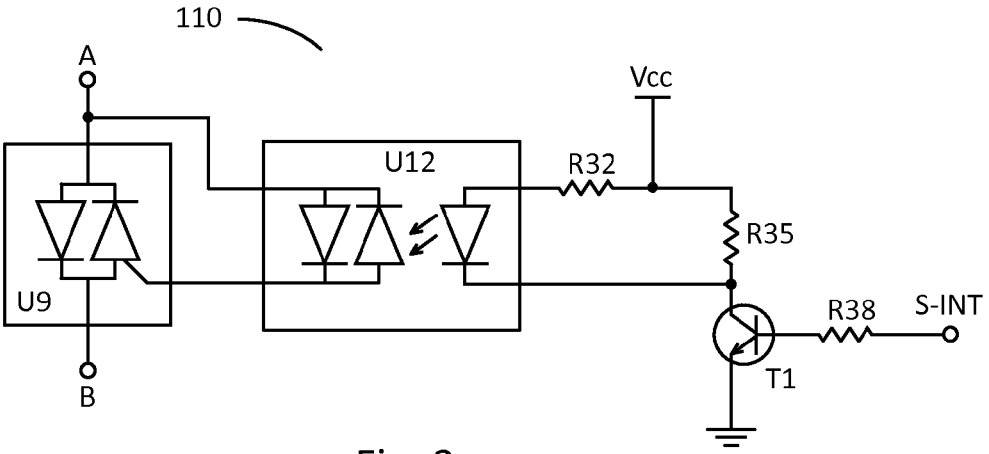
FIG. 3 is a schematic diagram illustrating an embodiment of the SCR module.

FIG. 3 is a schematic diagram illustrating an embodiment of the SCR module 110. The SCR module 110 includes a SCR unit U9 coupled between a node A and a node B. Referring back to FIG. 1, the node A is coupled to the live wire L through the current measurement module 105; and the node B is coupled to the neutral wire N through the LED light bulb 102. The SCR unit U9 is controlled by an optocoupler SCR device U12 which is in turn controlled by a transistor T1 through its associated resistors R32, R35 and F38. In one embodiment, the transistor T1 is a NPN type bipolar transistor with the control signal S-INT coupled to a base terminal of the transistor T1 through the resistor R38. When the control signal S-INT is at high voltage level, the transistor T1 will be turned on which will then turn on the optocoupler SCR device U12 and the SCR unit U9. When the control signal S-INT is at low voltage level, the transistor T1, the optocoupler SCR device U12 and the SCR unit U9 will be turned off.

Figure 4:
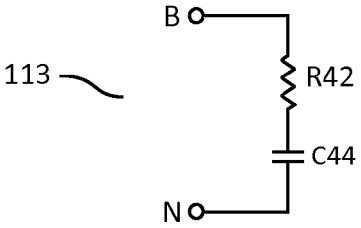
FIG. 4 is a schematic diagram illustrating an embodiment of the SCR start current module.

FIG. 4 is a schematic diagram illustrating an embodiment of the SCR start current module 113, which includes a resistor R42 and capacitor C44 parallelly coupled between the node B and the neutral wire N. As shown in FIG. 1, the LED light bulb 102 is also coupled between the node B and the neutral wire N. In operation, the capacitor C44 stores and releases energy following the AC current cycles between the live wire L and the neutral wire N. The released energy provides a start current for the SCR unit U9 of FIG. 3 when the SCR unit 9 is triggered by the signal S-INT to conduct.

Figure 5:
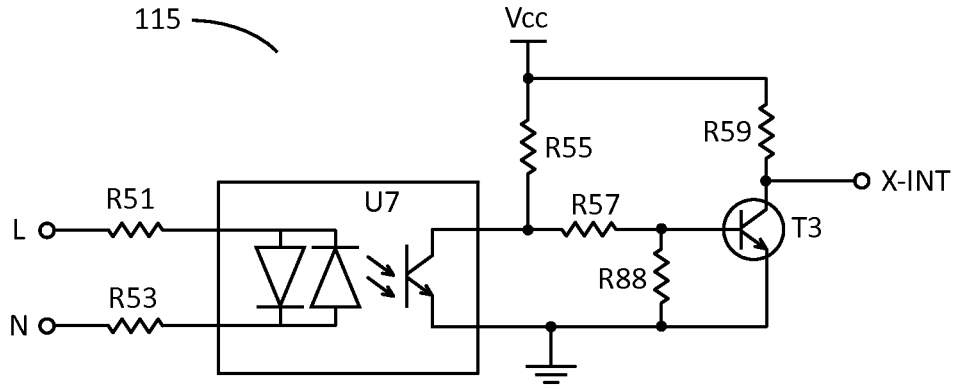
FIG. 5 is a schematic diagram illustrating an embodiment of the zero detection module.

FIG. 5 is a schematic diagram illustrating an embodiment of the zero detection module 115. The zero detection module 115 is coupled between the live wire L and the neutral wire N through resistors R51 and R53, respectively, and includes an optocoupler U7, a NPN transistor T3 and resistors R55, R57, R59 and R88. The optocoupler U7 produces an output voltage during both positive half cycle and negative half cycle of the AC current, which in turn turns on the transistor T3 and pulls the output signal X-INT to ground. However, when the AC current crosses at zero, the U7's output voltage becomes zero, and turns off the transistor T3. Therefore, the zero detection module 115 produces a positive pulse signal at X-INT at the moment of the AC current crossing at zero.

Referring back to FIG. 1, the signal X-INT is coupled to the controller 120, which generates the control signal S-INT from the signal X-INT. The control signal S-INT is also a positive pulse but there is a predetermined time delay from the pulse signal X-INT to the control pulse signal S-INT. The positive pulse of control signal S-INT triggers the SCR unit U9 to start conducting. The predetermined time delay may be empirically determined and then stored in the controller 120.

Figure 6:
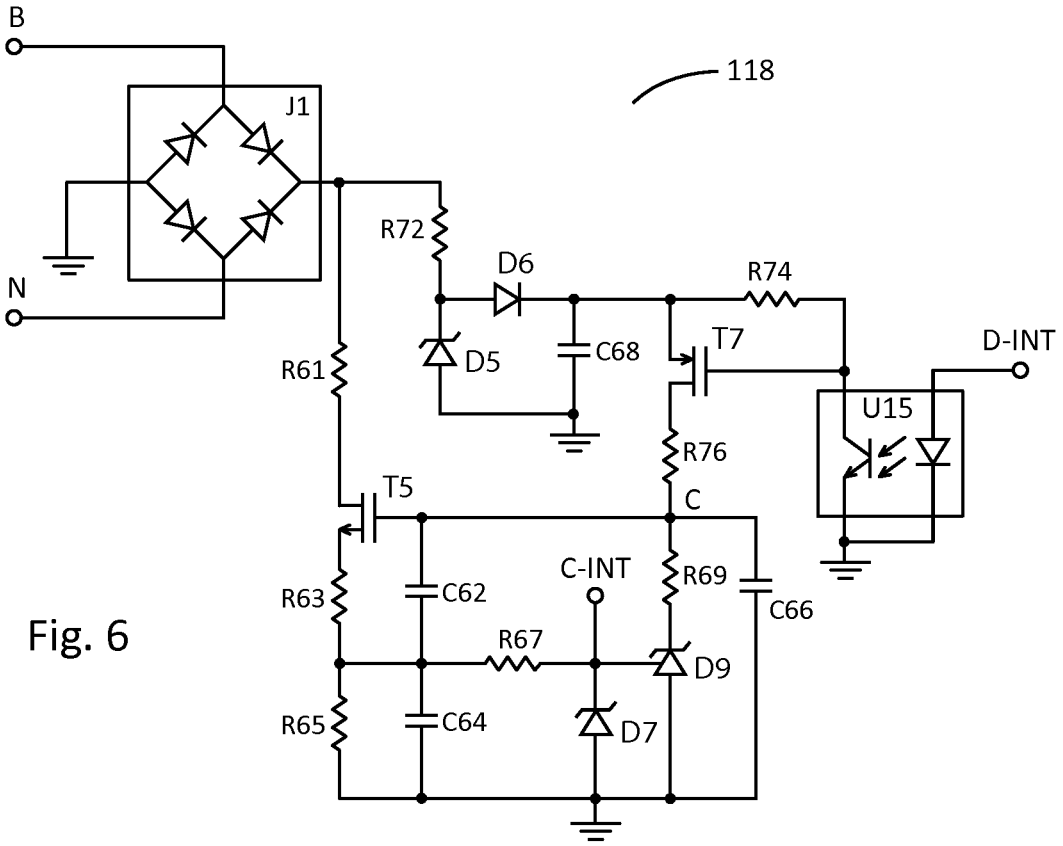
FIG. 6 is a schematic diagram illustrating an embodiment of the dynamic current maintenance module.

FIG. 6 is a schematic diagram illustrating an embodiment of the dynamic current maintenance module 118 which includes a full-wave rectifier J1 with inputs coupled between the node B and the neutral wire N. Outputs of the rectifier J1 are coupled between a source and a drain of a NMOS transistor T5 through resistors R61 at the drain side and resistors R63 and R65 at the source side thereof. The amount of current flowing through the NMOS transistor T5 determines the amount of current flowing between the node B and the neutral wire N. The NMOS transistor T5's conduction current is in turn determined by voltage at a node C.

Referring to FIG. 6 again, the dynamic current maintenance module 118 further includes a PMOS transistor T7 with a source connected to a constant voltage source provided by a Zener diode D5, a diode D6, a resistor R72 and a capacitor C68 coupled to the outputs of the rectifier J1. A drain of the PMOS transistor T7 is coupled to the node C through a resistor R76. A resistor R74 connected between the source and a gate of the PMOS transistor T7 turns the PMOS transistor T7 on if an optocoupler U15 coupled between the gate of the PMOS transistor T7 and the ground is on. The optocoupler U15 is controlled by a signal D-INT from the controller 120. When the signal D-INT is at high logic voltage level, the optocoupler U15 is on to pull the gate of the PMOS transistor T7 to ground to turn it on. When the signal D-INT is at low logic voltage level, the optocoupler U15 is off and the PMOS transistor T7 is off, too. Then the node C voltage is at the ground voltage level due to the capacitors C62, C64 and C66 coupled between the node C and the ground, and the NMOS transistor T5 is turned off. Therefore, when the dynamic current maintenance module 118 is not expected to draw current between the node B and the neutral wire N, the controller 120 can set the controller signal D-INT to low logic voltage level.

Referring to FIG. 6 again, the dynamic current maintenance module 118 further include a shunt regulator diode D9 with a cathode coupled to the node C through a resistor R69, an anode connected to the ground and a reference terminal connected to the signal C-INT. When voltage at the reference terminal increases, resistance of the shunt regulator diode D9 decreases proportionally. As depicted in FIG. 2 and associated description, voltage at the signal C-INT reflects the current flowing through the LED light bulb 102. When the current at the LED light bulb 102 runs low, the voltage at the signal C-INT is relatively low, and the resistance of the shunt regulator diode D9 is relatively high, and so is the node C. As a result, the NMOS transistor T5 becomes more conductive causing the dynamic current maintenance module 118 to draw more current from the node B and thus from the SCR module 110. In this way, the SCR module 110 will maintain an adequate conduction current level even when the LED light bulb 102 does not draw sufficient current.

On the other hand, when the LED light bulb 102 draws a relatively high current, voltage at the signal C-INT is relatively high, then the resistance of the shunt regulator diode D9 is relatively low, which in turn causes voltage at the node C to drop and so is the conduction of the NMOS transistor T5. As a result, the dynamic current maintenance module 118 draws less current in this situation. In summary, the current drew by the dynamic current maintenance module 118 is inversely proportional to the current flowing through the SCR module 110 and the LED light bulb 102.

Referring to FIG. 6 again, the dynamic current maintenance module 118 further includes a Zener diode D7 connected between the signal C-INT and the ground. The Zener diode D7 serves to protect the shunt regulator diode D9 from damage by surging voltage at the signal C-INT.

Figure 7:
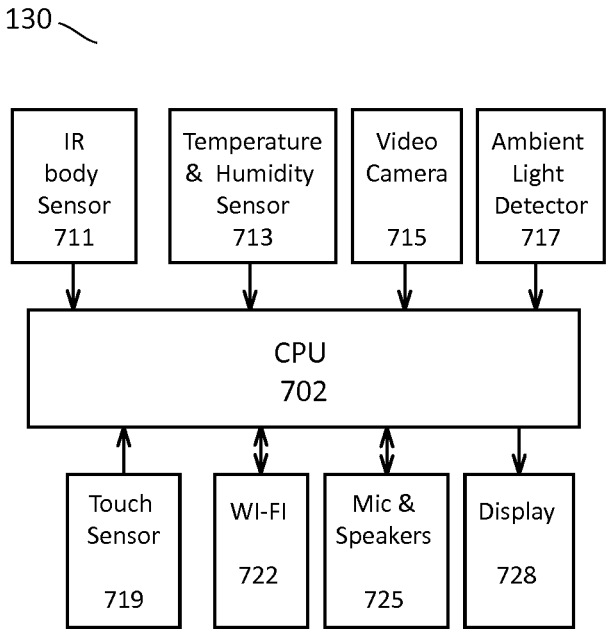
FIG. 7 is a block diagram illustrating an embodiment of the interface module.

FIG. 7 is a block diagram illustrating an embodiment of the interface module 130 which includes a central processing unit (CPU) 702, an infrared (IR) body sensor 711, a temperature and humidity sensor 713, a video camera 715, an ambient light detector 717, a touch sensor 719, and Wi-Fi unit 722, a microphone and speakers unit 725 and a display 728. The IR approach sensor 711, generally placed near the LED light bulb 102 senses the presence of a person in the vicinity thereof, and sends such information to the CPU 702 and then the controller 120 for controlling the LED light bulb 102. In operation, the LED light bulb 102 is turned on when the presence of a person is detected, and turned off when nobody is present after a certain period of time.

The temperature and humidity sensor 713 measures the environment temperature and humidity for being displayed in the display 728. In some embodiments, the display 728 employs a LED display panel.

The video camera 715 captures images and can be used as a security instrument. Captured images can be transmitted over the Internet through the Wi-Fi unit 722.

The ambient light detector 717 sense the ambient light intensity and sends the information to the controller 120 through the CPU 702 for automatically adjusting output of the LED light bulb 102. For instance, when the ambient light is relatively bright, the controller 120 controls the SCR module 110 to reduce the current supply to the LED light bulb 102.

The touch sensor 719 is for an operator to enter commands or settings to the CPU 702. In some embodiments, the touch sensor 719 employs a capacitive or a resistive touch panel, and overlays the display unit 728.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A circuit comprising, a silicon-controlled rectifier (SCR) configured to control a first current supplied to a light-emitting diode (LED) light bulb;

a current measurement module configured to generate a direct current (DC) indicating voltage proportional to the amplitude of the first current;

a controlled current load serially coupled to an anode or a cathode of the SCR and configured to draw a second current from the SCR, an amplitude of the second current being inversely proportional to an amplitude of the first current, the controlled current load including:

a rectifier configured to convert the second current to a DC current, the DC current controllably flowing through a first transistor having a control terminal controlled by the DC indicating voltage, wherein the high the DC indicating voltage is, the lower the DC current becomes;

a second transistor configured to controllably turn off the first transistor; and an optocoupler configured to controllably turn off the second transistor.

2. The circuit of claim 1, wherein the first and second current are alternating current (AC).

3. The circuit of claim 2 further comprising a zero detection module configured to produce a first pulse at a time when the first current crosses zero, the first pulse being used to generate a triggering pulse for the SCR.

4. The circuit of claim 3, wherein the triggering pulse is delayed from the first pulse by a predetermined time.

5. The circuit of claim 1, wherein the DC indicating voltage is inversely proportional to the amplitude of the second current.

6. The circuit of claim 1, wherein the first transistor is a NMOS transistor.

* * * * *